US005603545A

United States Patent [19]

Benson et al.

[11] Patent Number: 5,603,545

[45] Date of Patent: Feb. 18, 1997

[54] UNIVERSAL STRAP

[76] Inventors: Michael Benson; Kristine Benson, both of 56 Quaker St., Marlton, N.J. 08053

[21] Appl. No.: 480,338

[22] Filed: Jun. 7, 1995

[51] Int. Cl.[6] ..... A45F 5/00

[52] U.S. Cl. ..... 294/150; 294/159; 294/165; 224/578; 224/250; 224/257

[58] Field of Search ..... 294/137, 146, 294/147, 149, 150, 154, 155, 157, 159, 162, 164, 165; 224/151, 202, 250, 257, 917

[56] References Cited

U.S. PATENT DOCUMENTS

| | | | |
|---|---|---|---|
| 3,278,097 | 10/1966 | Duckworth | 294/147 |
| 4,529,240 | 7/1985 | Engel | 294/150 |
| 4,852,931 | 8/1989 | Ferdi | 294/147 |
| 4,911,347 | 3/1990 | Wilhite | 294/159 |
| 5,370,286 | 12/1994 | Newman | 294/149 |
| 5,437,401 | 8/1995 | Seltzer | 224/151 |

FOREIGN PATENT DOCUMENTS

| | | | |
|---|---|---|---|
| 8102577 | 12/1982 | Netherlands | 294/146 |

*Primary Examiner*—Dean Kramer
*Attorney, Agent, or Firm*—Simpson & Simpson, P.C.

[57] ABSTRACT

An adjustable length carrying strap that can be automatically adjusted, with little user manipulation, to tighten around an object to be carried. By utilizing two free-sliding connectors on each end of the carrying strap, the device easily and automatically tightens around the object to be carried when the object is lifted by the strap and easily and automatically loosens up when the user puts the object and strap down. This leaves the hands of the user free to perform other tasks. Although not required, an adjuster is provided to enable the length of the strap to be lengthened or shortened depending on the desires of the user. Further, the user may also quickly and easily release the object by uncoupling the two free-sliding connectors on either or both ends of the strap, thereby opening securing loops and releasing the carried object(s).

3 Claims, 3 Drawing Sheets

UNIVERSAL STRAP

FIELD OF THE INVENTION

This invention relates to devices for carrying objects, and more particularly, to a portable, adjustable carrying strap that can be simply and easily attached to a wide variety of objects to assist the user in carrying the objects.

BACKGROUND OF THE INVENTION

A common problem shared by many is the difficulty in carrying large, heavy, and/or unusual shaped objects from one place to another. Recreational activities such as going to the beach, hiking, camping, skiing, in-line skating, to name a few, often require the user to transport equipment from a storage area to a site for use of the equipment, and then repeat the process when the activity is completed. A parent with small children may want to spend a day at the beach with the children; several beach chairs, a beach umbrella and a cooler may all be included in the supplies being carried by the parent, requiring several trips to and from the car or house. Obviously, the parent cannot leave the children alone at the beach while making the trips to and from the car or house; thus, both the parent and the children often must make the same journey to and from the car or house several times.

Some people have resorted to including a wagon with their regular beach equipment, allowing the user to load the wagon with the days equipment and reduce the number of trips to be made. While this is an adequate solution, the wagon takes up considerable storage space that could be used for packing other items; further, this solution does not lend itself to skiing, hiking or other activities in which long distances may have to be traversed as part of the activity.

Various devices have been invented in attempting to overcome the above-mentioned problems. U.S. Pat. No. 4,015,762 to Mendillo teaches a portable ski carrier that essentially comprises a dog leash with an S-hook on one end and a loop on the other end. The device is used by placing the loop end around the skis on one side of the ski bindings and then threading the S-hook through the loop until the loop end tightly engages the skis. The hook end is then wrapped around the opposite end of the skis on the other side of the bindings and the hook is engaged with the strap by threading the strap through the open end or the S-hook. U.S. Pat. No. 5,190,336 to Palz teaches another ski carrier in which carrying loops are disposed at each end of the strap. U.S. Pat. No. 3,257,054 to Miesel teaches still another ski carrier in which a flexible cable is fitted with a spring clamp at each end of the cable. The device is used by passing each end of the cable about the skiing equipment and securing the clamps on the cable to form loops at each end of the cable.

In U.S. Pat. No. 5,370,286 to Newman, there is shown an adjustable carrying strap that can be folded into a small bundle or worn around the waist when not in use, and which can be used to carry a wide variety of items. The device of Newman includes two straps, connected to each other at adjustment points, and a connector is provided at each end of the device. Each connector comprises one free-sliding clip member and one D-ring that includes a gripping means to secure it in a normally stationary position. The D-ring is coupleable to the clip member. The location of the D-ring along the strap is fixed during use but is manually adjustable by manipulation of a bar slide associated with each D-ring, i.e., the D-ring/bar slide is not free-sliding. In use, the user must estimate the approximate location where the D-ring should be located to accommodate the object(s) to be carried and move the D-ring to that location. The object is then placed in a loop formed by connecting the clip member to the D-ring. If it is desired to tighten the loop around the object, the user must manipulate the bar slide associated with the D-ring to decrease the size of the loop. When the object has been transported to the desired location, the user must increase the size of the loop by manipulating the bar slide once again, and then either disconnect the clip member from the D-ring or slide the object out of the loop.

While the above devices provide adequate solutions to the problem of carrying items from one place to another, none of them provide the user with the capability of easy and automatic tightening of the carrying loops around the objects to be carried and easy loosening and unclipping of the carrying loops. For example, Newman requires manual manipulation to tighten the object being carried within the loops and requires additional manual manipulation to release the object from the tightened loop. Because of the bar slides used to tighten and loosen the loop, the tightening process is not easy and often requires the use of two hands. Further, the Newman device utilizes two straps and four different slide adjustment points, complicating the use and manufacture of the device. Palz utilizes closed loops that limit the use of the device to the carrying of objects that can fit in the loops and, in addition, requires manual tightening and untightening of the loops when it is desired to release the skis. Mendillo enables a slidable tightening or loosening of the end loops, but also requires the unthreading of the strap to disconnect the device from the object to be carried, i.e., there is no way of quickly releasing the loop end from the object to be carried. Further, each end of Mendillo has only a single sliding point for tightening of loosening, making the slidable tightening or loosening somewhat difficult. Likewise, the Meisel carrier has only a single slide point on each end, which makes the tightening and loosening of the end loops difficult. Nothing in the prior art teaches or suggests a device in which the user has the option of quickly loosening or tightening the end loops easily by using two free-sliding points on each end or quickly and easily opening both end loops.

SUMMARY OF THE INVENTION

The present invention is an adjustable length carrying strap that can be automatically adjusted, with little user manipulation, to tighten around an object to be carried. By utilizing two free-sliding connection means on each end of the carrying strap, the device easily and automatically tightens around the object to be carried when the object is lifted by the strap and easily and automatically loosens up when the user puts the object and strap down. This leaves the hands of the user free to perform other tasks. Although not required, adjustment means is provided to enable the length of the strap to be lengthened or shortened depending on the desires of the user. Further, the user may also quickly and easily release the object by uncoupling the two free-sliding connection means on either or both ends of the strap, thereby opening the loops and releasing the carried object(s).

An illustrative embodiment of the invention comprises an elongated strap member having a first end and a second end, and having a first major loop formed at said first end and a second major loop formed at said second end; a first freely slideable male clip member connected to said first major loop; a first freely slideable female clip member connected to said first major loop; a second freely slideable male clip member connected to said second major loop; and a second freely slideable female clip member connected to said second major loop, wherein said first major loop is formable into a first closed minor loop and first openable minor loops, said first minor openable loop being opened when said first freely slideable male clip member and said first freely slideable female clip member are disengaged from each other and closed when said first freely slidable male clip member and said first freely slidable female clip member are engaged with each other, and wherein said second major loop is formable into a second closed minor loop and a second openable minor loop, said second minor openable loop being opened when said second freely slideable male clip member and said second freely slideable female clip member are disengaged from each other and closed when said second freely slideable male clip member and said second freely slideable female clip member are engaged with each other.

DETAILED DESCRIPTION

Figure 1:
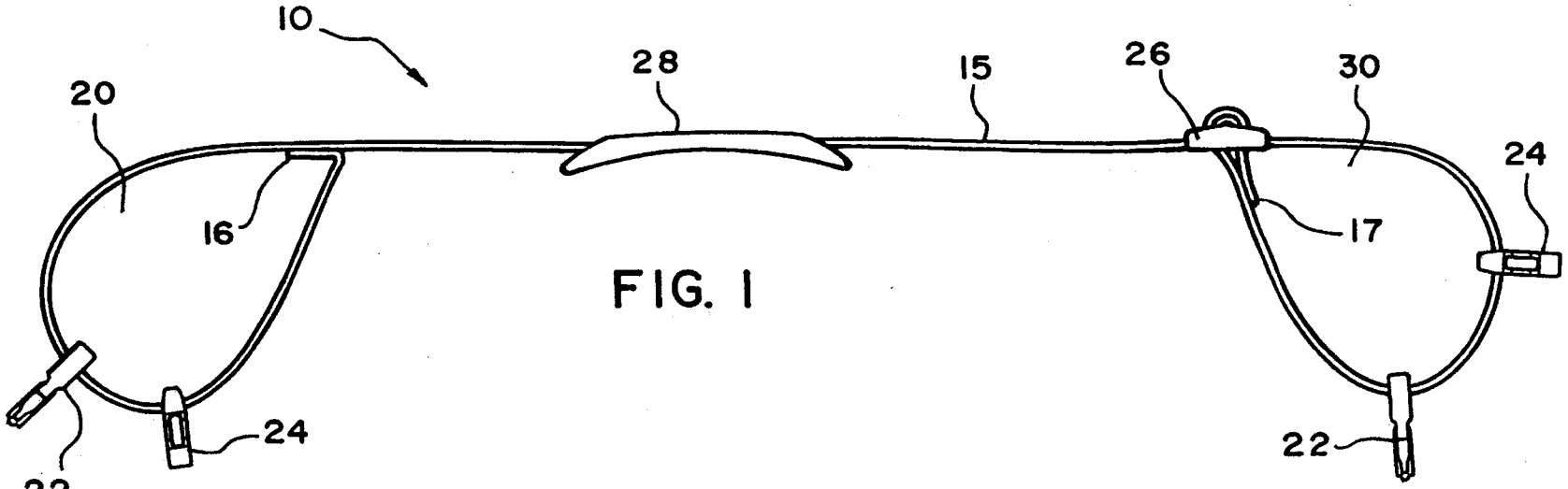
FIG. 1 is an elevational view of the adjustable strap according to the present invention.

FIGS. 1–5 illustrate a strap 10 embodying the present invention. Strap 10 comprises a single elongated flexible strap member 15 of, for example, woven nylon webbing or other suitable flexible, lightweight material having a high tensile strength, and having ends 16 and 17. Major loops 20 and 30 are formed at opposite ends of flexible strap member 15. In the embodiment shown in FIG. 1, major loop 20 is formed by first passing end 16 through slot 23 of a male clip member 22 and then through slot 25 of a female clip member 24. End 16 is then folded back and coupled to flexible strap member 15 as shown by, for example, sewing, riveting, or other known connection means. The size of major loop 20 formed in this manner can, of course, vary; however, for practical reasons, applicant recommends that the major loop 20 have a diameter of at least five inches.

Figure 5A:
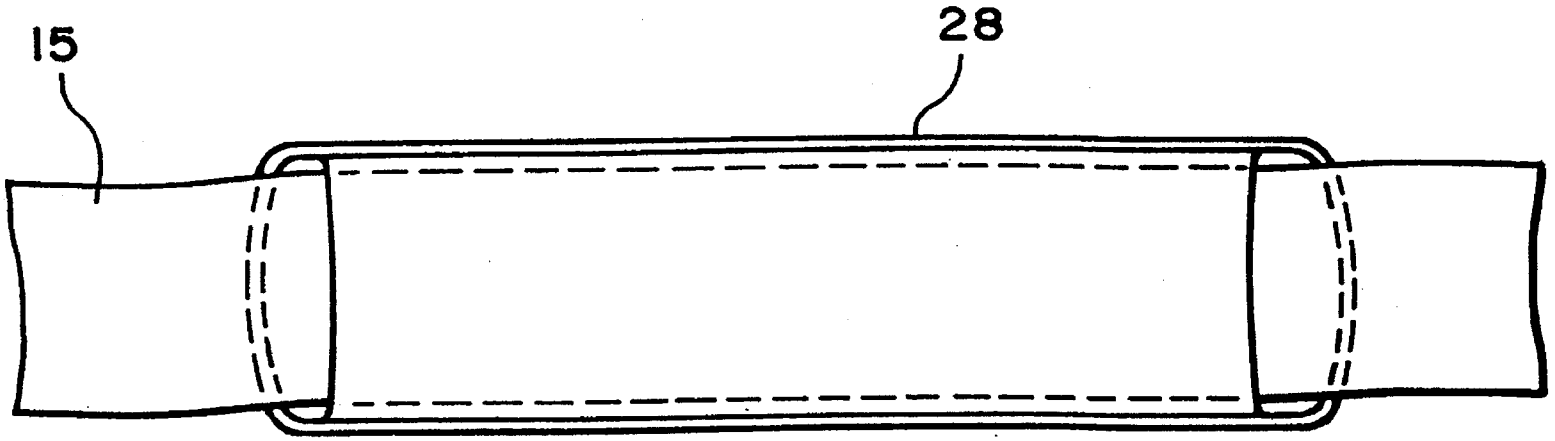
FIGS. 5*a* and 5*b* are, respectively, an top and side view of a shoulder pad in accordance with the preferred embodiment of the present invention.
Figure 5B:
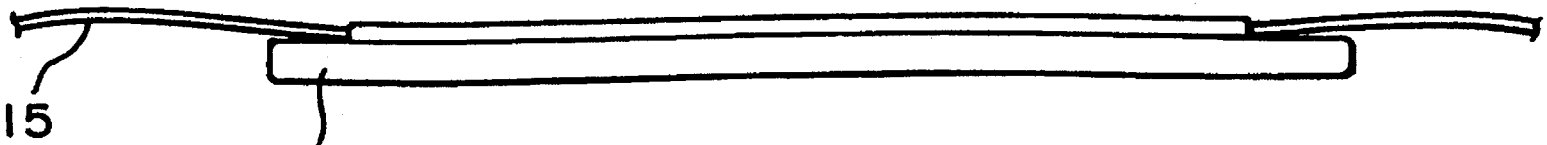

In the embodiment illustrated in FIG. 1, major loop 30 is formed in a manner slightly different to that of major loop 20. First, although shoulder pad 28 as shown in FIG. 5 is not associated separately with either major loop, flexible strap member 15 must be inserted through shoulder pad 28 before both ends 16 and 17 of flexible strap member 15 are sewn, riveted, or otherwise fastened back to flexible strap member 15. End 17 is then slipped under a first outer bar 27 of a single central bar slide 26, over the central bar 28 and under the second outer bar 29. Next, the end 17 is passed through slot 25 of a second female clip member 24 and then through slot 23 of a second male clip member 22. Finally, the end 17 is passed between first outer bar 27 and central bar 28 of central bar slide 26, then over central bar 28 and back down between central bar 28 and second outer bar 29 of central bar slide 26, where it is fastened, by sewing, riveting, or other attaching means, to flexible strap member 15 as shown in FIG. 1.

Figure 6:
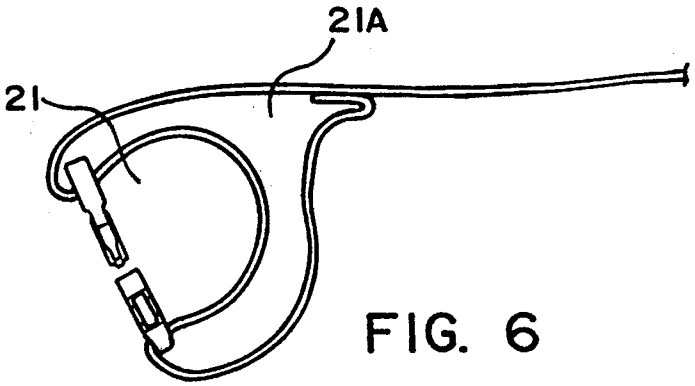
FIG. 6 is a perspective view of one configuration for use of the present invention.
Figure 7:
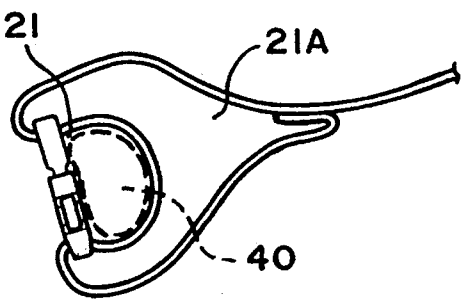
FIG. 7 is a perspective view of one configuration for use of the present invention.
Figure 3A:
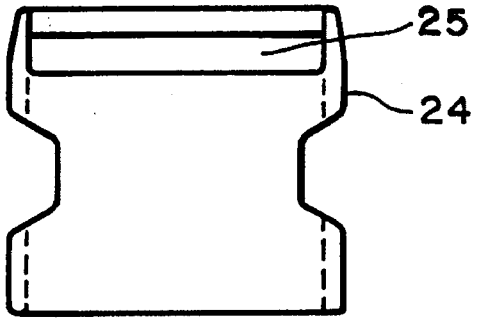
FIGS. 3*a* and 3*b* are, respectively, a front and side view of a female clip member in accordance with the preferred embodiment of the present invention.
Figure 3B:
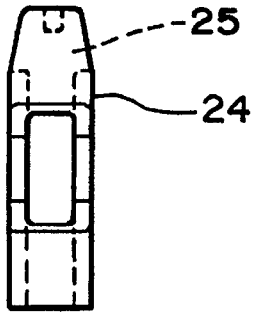
Figure 2A:
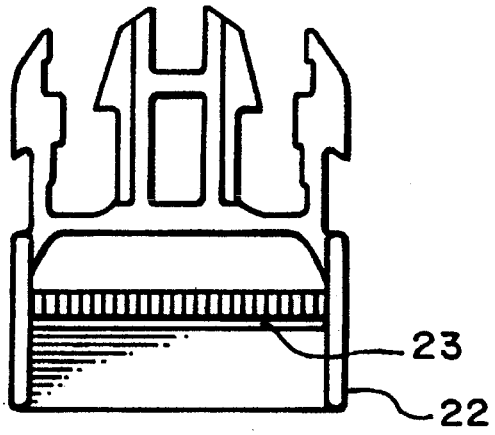
FIGS. 2*a* and 2*b* are, respectively, a front and side view of a male clip member in accordance with the preferred embodiment of the present invention.
Figure 2B:
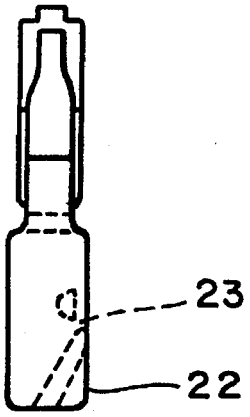
Figure 4:
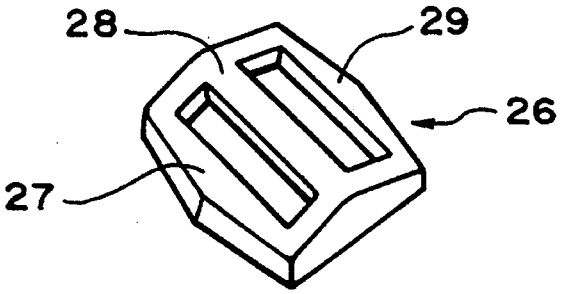
FIG. 4 is a plan view of a central bar slide in accordance with the preferred embodiment of the present invention.

Use of the present invention is described with additional reference made to FIGS. 6 and 7. To use the device described above, the user slides the male and female clip members 22 and 24 of major loop 20 (or major loop 30) apart from each other, grasping both male and female connectors 22 and 24, and takes one of them and wraps it around the item to be carried 40 (shown in phantom lines in FIG. 7). This forms an openable minor loop 21 and a closed minor loop 21A as shown in FIGS. 6 and 7. The male and female connectors 22 and 24 are then coupled together, securing the minor loop 21 around the object to be carried 40 as shown in FIG. 7. The same procedure is followed for the other set of male/female connectors of the other loop. Once both sets of connectors are attached to the device in this manner, the user need only lift the strap, and the weight of the object being carried acts on the free-sliding male and female connectors, tightening openable minor loops 21 around the object to be carried 40. When the object is lowered back to the ground, the free-sliding male and female connectors 22 and 24 loosen slightly, facilitating easy removal.

Because of the configuration of the connectors, objects of many different sizes and shapes can be carried with the invention. It is not always necessary to clip and un-clip the connectors when removing and/or inserting the objects. For example, skis can be slipped in and out of the carrying loop without uncoupling the male and female connectors; the free-sliding connectors make it simple and easy to remove or secure the skis.

The male and female connectors are placed on the strap in the manner described and shown in FIG. 1 (i.e., with the female connector of major loop 20 closest to end 16, and with the male connector of major loop 30 closest to end 17) so that, when the device is not in use, the male connector associated with major loop 20 can be connected to the female connector of major loop 30 and the female connector of major loop 20 can be connected to the male connector of major loop 30, in such a manner that the flexible strap 15 is not twisted. This allows the strap 10 to be neatly and compactly folded, or comfortably worn like a belt, when it is not being used to carry objects.

This invention can be used for carrying any object that can be secured using a loop. For example, coolers, beach bags, umbrellas, in-line skates, briefcases, luggage, camping equipment, skis, sleds, and tools are just a few of the items contemplated by the applicant as being able to be carried by the present invention.

The many features and advantages of the invention are apparent from the detailed specification and thus it is intended by the appended claims to cover all such features and advantages of the invention which fall within the true spirit and scope thereof. Further, since numerous modifications and changes will readily occur to those skilled in the art, it is not desired to limit the invention to the exact construction and operation illustrated and described and, accordingly, all suitable modifications and equivalents may be resorted to, falling within the scope of the invention. For example, instead of using two differently constructed major loops 20 and 30 as shown in FIG. 1, two identically constructed major loops 20 (i.e., without the central bar slide 26) could be used to form a strap whose length is not adjustable; conversely, two identically constructed major loops 30 (i.e., with a central bar slide on each end) could be used, rendering the strap adjustable at two locations and also allowing for adjustment of the size of both carrying loops. Further, there are a variety of free-sliding male/female connectors that can be used in place of the connectors disclosed herein. Obviously a variety of different connectors could be used subject to the requirement that both male and female connectors be free-sliding.

We claim:

1. A universal carrying strap, comprising:

an elongated strap member having a first end and a second end, and having a first major loop formed at said first end and a second major loop formed at said second end;

a first freely slideable male clip member connected to and freely slidable along said first major loop;

a first freely slideable female clip member connected to and freely slidable along said first major loop;

a second freely slideable male clip member connected to and freely slidable along said second major loop; and a second freely slideable female clip member connected to and freely slidable along said second major loop, wherein said first major loop is formable into a first closed minor loop and first openable minor loop, said first minor openable loop being opened when said first freely slideable male clip member and said first freely slideable female clip member are disengaged from each other and closed when said first freely slidable male clip member and said first freely slidable female clip member are engaged with each other, and wherein said second major loop is formable into a second closed minor loop and a second openable minor loop, said second minor openable loop being opened when said second freely slideable male clip member and said second freely slideable female clip member are disengaged from each other and closed when said second freely slideable male clip member and said second freely slideable female clip member are engaged with each other.

2. A universal carrying strap as set forth in claim 1 wherein said first major loop includes means for adjusting the size thereof.

3. A universal carrying strap as set forth in claim 2 wherein said second major loop includes means for adjusting the size thereof.

* * * * *